US010413039B2

(12) United States Patent
Gurure

(10) Patent No.: US 10,413,039 B2
(45) Date of Patent: Sep. 17, 2019

(54) DUAL CHAMBER CONTAINER ASSEMBLY

(71) Applicant: Tabetha Gurure, Frisco, TX (US)

(72) Inventor: Tabetha Gurure, Frisco, TX (US)

( * ) Notice: Subject to any disclaimer, the term of this patent is extended or adjusted under 35 U.S.C. 154(b) by 106 days.

(21) Appl. No.: 15/672,986

(22) Filed: Aug. 9, 2017

(65) Prior Publication Data

US 2019/0045905 A1 Feb. 14, 2019

(51) Int. Cl.
*A45D 34/04* (2006.01)
*A45D 40/24* (2006.01)

(52) U.S. Cl.
CPC ..... *A45D 34/045* (2013.01); *A45D 40/24* (2013.01)

(58) Field of Classification Search
CPC ..... A45D 34/045; A45D 40/24; B65D 41/28
See application file for complete search history.

(56) References Cited

U.S. PATENT DOCUMENTS 4,600,328 A * 7/1986 Clements ..... A45D 40/24 132/218
4,666,043 A * 5/1987 Tahara ..... A45D 40/10 132/318
D326,606 S 6/1992 Green
6,120,202 A 9/2000 Donsky
D449,224 S 10/2001 Kaufman
8,235,239 B2 8/2012 Kountotsis
8,523,473 B2 * 9/2013 Kim ..... A45D 34/043 401/126
9,033,603 B2 * 5/2015 Vanoncini ..... A45D 34/045 401/126
2002/0094224 A1 7/2002 Kaufman
2005/0084318 A1 4/2005 Bland
2010/0322694 A1 * 12/2010 Kim ..... A45D 40/24 401/35
2011/0020047 A1 * 1/2011 Kim ..... A45D 34/045 401/35

* cited by examiner

*Primary Examiner* — David P Angwin
*Assistant Examiner* — Bradley S Oliver

(57) ABSTRACT

A dual chamber container assembly includes a bottle. The bottle has a divider therein to define a first half and a second half of the bottle. The first half contains a first fluid and the second half contains a second fluid. A cap is provided and the cap is split into a primary half and a secondary half and each of the primary and secondary halves is selectively manipulated. Each of the primary half and the secondary half is removably coupled to the bottle. The primary half of the cap is aligned with the first half of the bottle and the secondary half of the cap is aligned with the second half of the bottle. A pair of brushes is each coupled to an associated one of the primary and secondary halves of the cap. Each of the brushes is manipulated to selectively apply the fluid to a surface.

14 Claims, 4 Drawing Sheets

DUAL CHAMBER CONTAINER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to container devices and more particularly pertains to a new container device for containing two distinct colors of nail polish.

BRIEF SUMMARY OF THE INVENTION

An embodiment of the disclosure meets the needs presented above by generally comprising a bottle. The bottle has a divider therein to define a first half and a second half of the bottle. The first half contains a first fluid and the second half contains a second fluid. A cap is provided and the cap is split into a primary half and a secondary half and each of the primary and secondary halves is selectively manipulated. Each of the primary half and the secondary half is removably coupled to the bottle. The primary half of the cap is aligned with the first half of the bottle and the secondary half of the cap is aligned with the second half of the bottle. A pair of brushes is each coupled to an associated one of the primary and secondary halves of the cap. Each of the brushes is manipulated to selectively apply the fluid to a surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
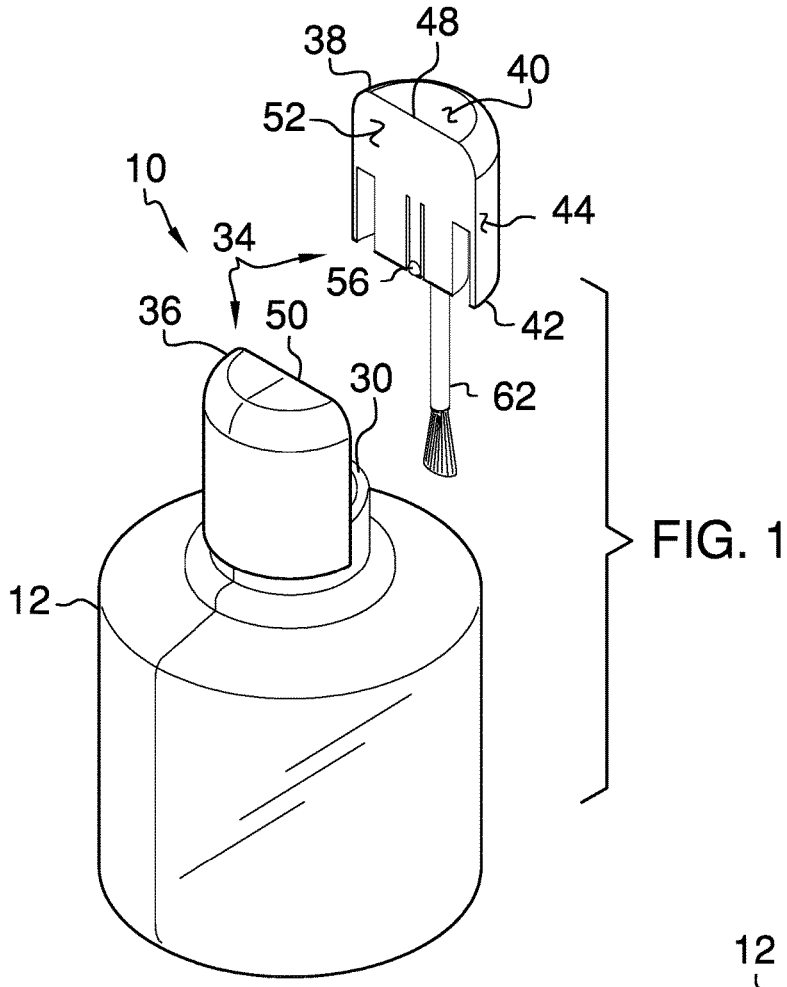
FIG. 1 is a perspective view of a dual chamber container assembly according to an embodiment of the disclosure.
Figure 2:
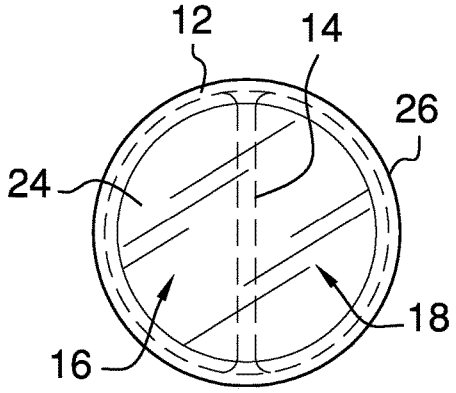
FIG. 2 is a bottom phantom view of an embodiment of the disclosure.
Figure 3:
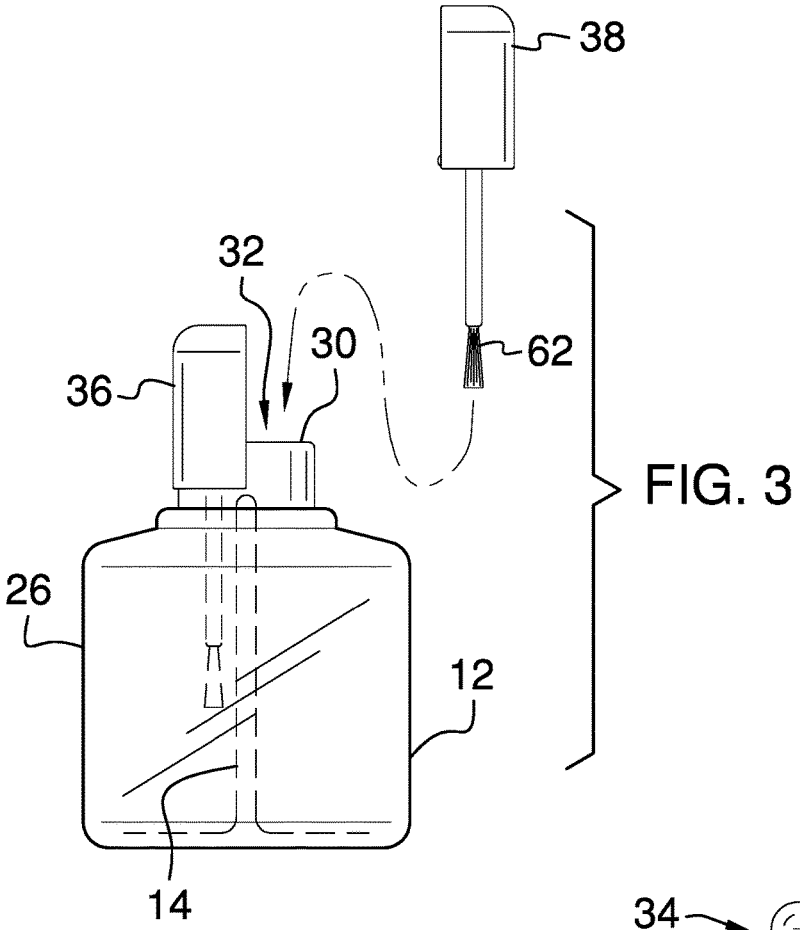
FIG. 3 is an exploded perspective view of an embodiment of the disclosure.
Figure 4:
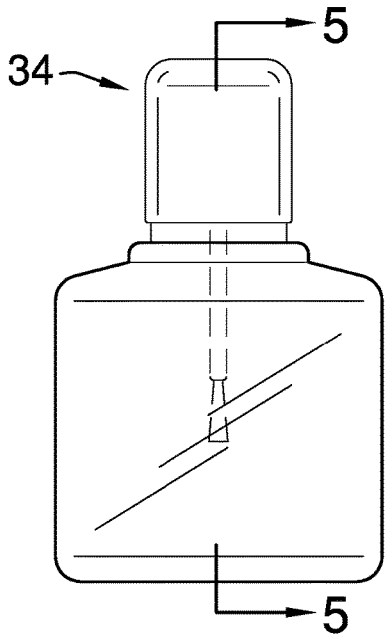
FIG. 4 is a phantom view of an embodiment of the disclosure.
Figure 5:
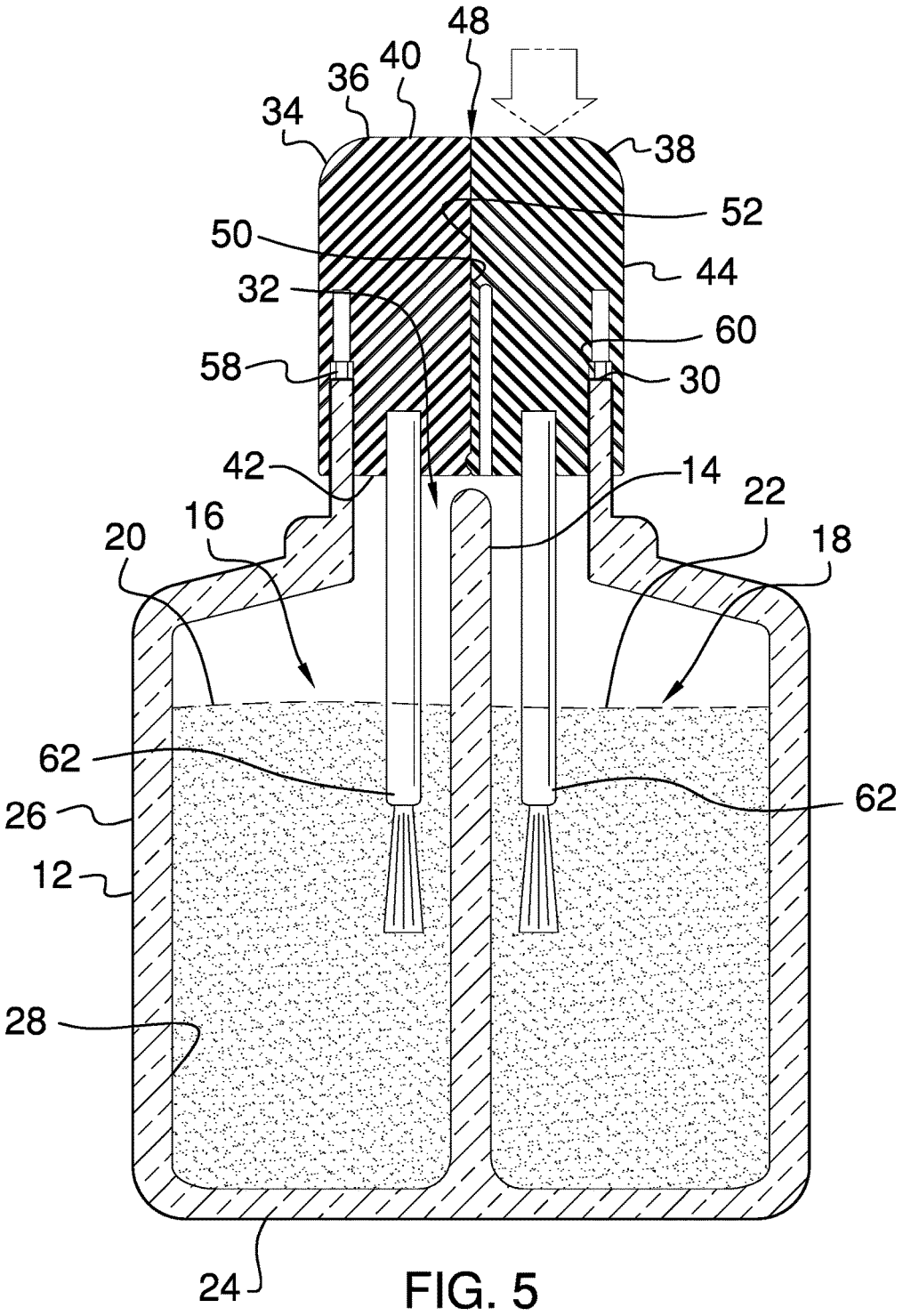
FIG. 5 is a cross sectional view taken along line 5-5 of FIG. 4 of an embodiment of the disclosure showing a second biasing member in a first position.
Figure 6:
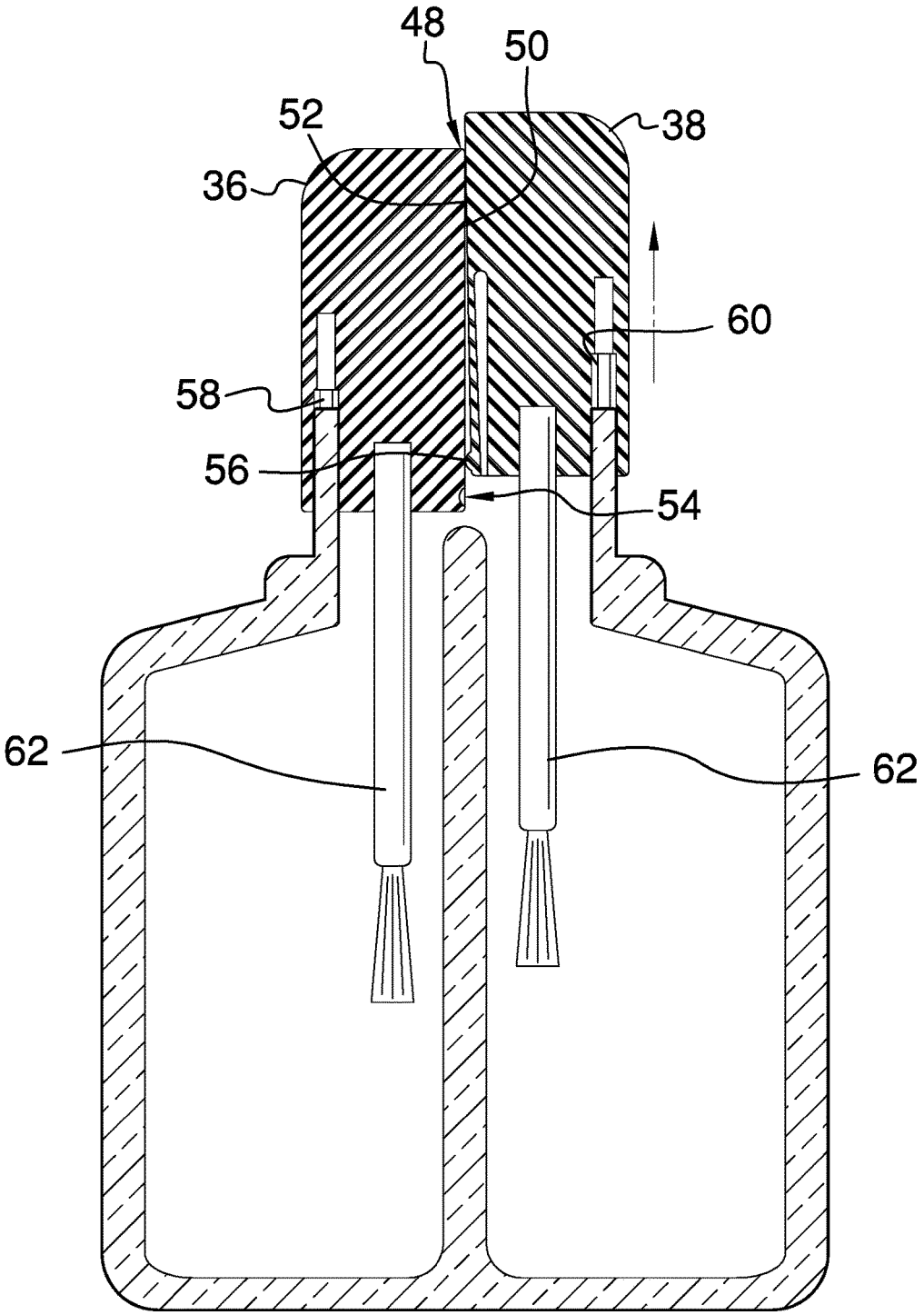
FIG. 6 is a cross sectional view taken along line 5-5 of FIG. 4 showing a second biasing member in a second position an embodiment of the disclosure.

With reference now to the drawings, and in particular to FIGS. 1 through 6 thereof, a new container device embodying the principles and concepts of an embodiment of the disclosure and generally designated by the reference numeral 10 will be described.

As best illustrated in FIGS. 1 through 6, the dual chamber container assembly 10 generally comprises a bottle 12 that has a divider 14 therein to define a first half 16 and a second half 18 of the bottle 12. The first half 16 contains a first fluid 20 and the second half 18 contains a second fluid 22. Each of the first 20 and second 22 fluids may be nail polish that has a distinct color from each other. In this way two different colors of nail polish may be contained in a single bottle.

The bottle 12 has a basal wall 24 and an outer wall 26 extending upwardly therefrom. The bottle 12 has an inside surface 28 and the outer wall 26 is continuous such that the bottle 12 has a cylindrical shape. The outer wall 26 has a distal edge 30 with respect to the basal wall 24 to define an opening 32 into the bottle 12. Additionally, the outer wall 26 may have a horizontal surface extending between a top half of the bottle 12 and a bottom half of the bottle 12. The top half may have a diameter that is less than a diameter of the bottom half. The divider 14 is coupled to the inside surface 28 corresponding to the outer wall 26. The divider 14 extends vertically between the inside surface 28 corresponding to the basal wall 24 and the distal edge 30 of the outer wall 26.

A cap 34 is provided to close the bottle 12. The cap 34 is split into a primary half 36 and a secondary half 38 and each of the primary 36 and secondary 38 halves are selectively manipulated. Each of the primary half 36 and the secondary half 38 is removably coupled to the bottle 12. The primary half 36 of the cap 34 is aligned with the first half 16 of the bottle 12 and the secondary half 38 of the cap 34 is aligned with the second half 18 of the bottle 12.

The cap 34 has a first surface 40, a second surface 42 and an outer surface 44 extending therebetween. The outer surface 44 is continuous such that the cap 34 has a cylindrical shape. The first surface 40 has a first well 46 extending toward the second surface 42. The first well 46 is coextensive with the outer surface 44 such that the first well 46 forms a closed loop. Moreover, the first well 46 insertably receives the distal edge 30 of the bottle 12 when the cap 34 is positioned on the bottle 12.

The cap 34 has a cut 48 extending through the first 40 and second 42 surfaces to define the primary half 36 and the secondary half 38 of the cap 34. The cut 48 defines a first bounding surface 50 on the primary half 36 and a second bounding surface 52 on the secondary half 38. The second bounding surface 52 has a second well 54 extending toward the outer surface 44 of the secondary half 38. The first bounding surface 50 has a prominence 56 extending outwardly therefrom. The prominence 56 engages the second well 54 when each of the primary 36 and secondary 38 halves of the cap 34 are positioned on the bottle 12. In this way each of the primary 36 and secondary 38 halves are retained on the bottle 12 to close the bottle 12. The prominence 56 may be positioned on a tab or the like thereby facilitating the prominence 56 to be selectively urged away from the second well 54.

A first biasing member 58 is movably is positioned in the first well 46 corresponding to the primary half 36. The first biasing member 58 engages the distal edge 30 of the bottle 12 when the primary half 36 is positioned on the bottle 12. The first biasing member 58 is selectively urged into a first position when the second surface 42 of the primary half 36 is urged downwardly. The first biasing member 58 is inhibited from urging the primary half 36 upwardly from the distal edge 30 when the first biasing member 58 is in the first position. The first biasing member 58 is selectively urged into a second position when the second surface 42 of the primary half 36 is urged downwardly and the first biasing member 58 is in the first position. Moreover, the first biasing member 58 urges the primary half 36 upwardly on the distal edge 30 when the first biasing member 58 is urged into the second position.

A second biasing member 60 is movably is positioned in the first well 46 corresponding to the secondary half 38. The second biasing member 60 engages the distal edge 30 of the bottle 12 when the secondary half 38 is positioned on the bottle 12. The second biasing member 60 is selectively urged into a first position when the second surface 42 of the secondary half 38 is urged downwardly. The second biasing member 60 is inhibited from urging the secondary half 38 upwardly from the distal edge 30 when the second biasing member 60 is in the first position. The second biasing member 60 is selectively urged into a second position when the second surface 42 of the secondary half 38 is urged downwardly and the second biasing member 60 is in the first position. Moreover, the second biasing member 60 urges the secondary half 38 upwardly on the distal edge 30 when the second biasing member 60 is urged into the second position. Each of the first 58 and second 60 biasing members may comprise a spring loaded mechanism similar to a ballpoint pen retractor.

A pair of brushes 62 is provided and each of the brushes 62 is coupled to an associated one of the primary 36 and secondary 38 halves of the cap 34. Each of the brushes 62 extends downwardly into an associated one of the first half 16 and the second half 18 of the bottle 12. In this way each of the brushes 62 is positioned in the corresponding first fluid 20 and second fluid 22. Each of the brushes 62 is manipulated to apply the corresponding first 20 and second 22 fluid to a surface, such as a fingernail or the like. Each of the brushes 62 is positioned on the first surface 40 corresponding to the associated primary 36 and secondary 38 halves of the cap 34. Moreover, each of the brushes 62 may be a fingernail paint brush of any conventional design.

In use, a selected one of the primary 36 and secondary 38 halves of the cap 34 is pressed downwardly. Thus, the corresponding first 58 and second 60 biasing members are urged into the second position thereby urging the selected primary 36 and secondary 38 half upwardly on the bottle 12. In this way the selected primary 36 and secondary 38 half of the cap 34 is removed and manipulated to paint the fingernail. The selected primary 36 and secondary 38 half of the cap 34 is selectively positioned on the bottle 12. The first well 46 on the selected primary 36 and secondary 38 half of the bottle 12 receives the distal edge 30 of the bottle 12. The selected primary 36 and secondary 38 half of the bottle 12 is urged downwardly until the corresponding first 58 and second 60 biasing member is urged into the first position and the prominence 56 engages the second well 54. In this way each of the primary 36 and secondary 38 half of the cap 34 is retained on the bottle 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dual chamber container assembly being configured to contain a pair of fluids, said assembly comprising:

a bottle having a divider therein to define a first half and a second half of said bottle, said first half being configured to contain a first fluid, said second half being configured to contain a second fluid;

a cap being split into a primary half and a secondary half wherein each of said primary and secondary halves is configured to be manipulated, each of said primary half and said secondary half being removably coupled to said bottle, said primary half of said cap being aligned with said first half of said bottle, said secondary half of said cap being aligned with said second half of said bottle, said cap having a first surface, a second surface and an outer surface extending therebetween, said outer surface being continuous such that said cap has a cylindrical shape, said first surface having a first well extending toward said second surface, said first well being coextensive with said outer surface such that said first well forms a closed loop, said first well insertably receiving said distal edge of said bottle when said cap is positioned on said bottle; and a pair of brushes, each of said brushes being coupled to an associated one of said primary and secondary halves of said cap wherein each of said brushes is configured to selectively apply the fluid to a surface.

2. The assembly according to claim 1, wherein said bottle has a basal wall and an outer wall extending upwardly therefrom, said bottle having an inside surface, said outer wall being continuous such that said bottle has a cylindrical shape, said outer wall having a distal edge with respect to said bottom wall to define an opening into said bottle.

3. The assembly according to claim 2, wherein said divider is coupled to said inside surface corresponding to said outer wall, said divider extending vertically between said inside surface corresponding to said basal wall and said distal edge of said outer wall.

4. The assembly according to claim 1, wherein said cap has a cut extending through said first and second surfaces to define said primary half and said secondary half of said cap, said cut defining a first bounding surface on said primary half and a second bounding surface on said secondary half.

5. The assembly according to claim 4, wherein said second bounding surface has a second well extending toward said outer surface of said secondary half.

6. The assembly according to claim 5, wherein said first bounding surface has a prominence extending outwardly therefrom, said prominence engaging said second well when each of said primary and secondary halves of said cap is positioned on said bottle.

7. The assembly according to claim 4, further comprising a first biasing member being movably being positioned in said first well corresponding to said primary half, said first biasing member engaging a distal edge of said bottle when said primary half is positioned on said bottle.

8. The assembly according to claim 7, wherein said first biasing member is selectively urged into a first position when said second surface of said primary half is urged downwardly such that said first biasing member is inhibited from urging said primary half upwardly from said distal edge.

9. The assembly according to claim 8, wherein said first biasing member is selectively urged into a second position when said second surface of said primary half is urged downwardly and said first biasing member is in said first position such that said first biasing member urges said primary half upwardly on said distal edge.

10. The assembly according to claim 7, further comprising a second biasing member being movably being positioned in said first well corresponding to said secondary half, said second biasing member engaging said distal edge of said bottle when said secondary half is positioned on said bottle.

11. The assembly according to claim 10, wherein said second biasing member is selectively urged into a first position when said second surface of said secondary half is urged downwardly such that said second biasing member is inhibited from urging said secondary half upwardly from said distal edge.

12. The assembly according to claim 11, wherein said second biasing member is selectively urged into a second position when said second surface of said secondary half is urged downwardly and said second biasing member is in said first position such that said second biasing member urges said secondary half upwardly on said distal edge.

13. The assembly according to claim 4, wherein each of said brushes extends downwardly into an associated one of said first half and said second half of said bottle wherein each of said brushes is configured to be positioned in the corresponding first fluid and second fluid, each of said brushes being configured to apply the corresponding first and second fluid to a surface when said primary and secondary halves of said cap are manipulated, each of said brushes being positioned on said first surface corresponding to said associated first and second halves of said cap.

14. A dual chamber container assembly being configured to contain a pair of fluids, said assembly comprising:

a bottle having a divider therein to define a first half and a second half of said bottle, said first half being configured to contain a first fluid, said second half being configured to contain a second fluid, said bottle having a basal wall and an outer wall extending upwardly therefrom, said bottle having an inside surface, said outer wall being continuous such that said bottle has a cylindrical shape, said outer wall having a distal edge with respect to said bottom wall to define an opening into said bottle, said divider being coupled to said inside surface corresponding to said outer wall, said divider extending vertically between said inside surface corresponding to said basal wall and said distal edge of said outer wall;

a cap being split into a primary half and a secondary half wherein each of said primary and secondary halves is configured to be manipulated, each of said primary half and said secondary half being removably coupled to said bottle, said primary half of said cap being aligned with said first half of said bottle, said secondary half of said cap being aligned with said second half of said bottle, said cap having a first surface, a second surface and an outer surface extending therebetween, said outer surface being continuous such that said cap has a cylindrical shape, said first surface having a first well extending toward said second surface, said first well being coextensive with said outer surface such that said first well forms a closed loop, said first well insertably receiving said distal edge of said bottle when said cap is positioned on said bottle, said cap having a cut extending through said first and second surfaces to define said primary half and said secondary half of said cap, said cut defining a first bounding surface on said primary half and a second bounding surface on said secondary half, said second bounding surface having a second well extending toward said outer surface of said secondary half, said first bounding surface having a prominence extending outwardly therefrom, said prominence engaging said second well when each of said primary and secondary halves of said cap is positioned on said bottle;

a first biasing member being movably being positioned in said first well corresponding to said primary half, said first biasing member engaging said distal edge of said bottle when said primary half is positioned on said bottle, said first biasing member being selectively urged into a first position when said second surface of said primary half is urged downwardly such that said first biasing member is inhibited from urging said primary half upwardly from said distal edge, said first biasing member being selectively urged into a second position when said second surface of said primary half is urged downwardly and said first biasing member is in said first position such that said first biasing member urges said primary half upwardly on said distal edge;

a second biasing member being movably being positioned in said first well corresponding to said secondary half, said second biasing member engaging said distal edge of said bottle when said secondary half is positioned on said bottle, said second biasing member being selectively urged into a first position when said second surface of said secondary half is urged downwardly such that said second biasing member is inhibited from urging said secondary half upwardly from said distal edge, said second biasing member being selectively urged into a second position when said second surface of said secondary half is urged downwardly and said second biasing member is in said first position such that said second biasing member urges said secondary half upwardly on said distal edge; and a pair of brushes, each of said brushes being coupled to an associated one of said primary and secondary halves of said cap, each of said brushes extending downwardly into an associated one of said first half and said second half of said bottle wherein each of said brushes is configured to be positioned in the corresponding first fluid and second fluid, each of said brushes being configured to apply the corresponding first and second fluid to a surface when said primary and secondary halves of said cap are manipulated, each of said brushes being positioned on said first surface corresponding to said associated first and second halves of said cap.

* * * * *